US005888054A

United States Patent [19]

Djordjevic

[11] Patent Number: 5,888,054

[45] **Date of Patent: *Mar. 30, 1999**

[54] FUEL PUMP HAVING DUAL PROFILE CAM RING FOR DRIVING LOW AND HIGH PRESSURE RECIPROCATING PLUNGERS

[75] Inventor: Ilija Djordjevic, East Granby, Conn.

[73] Assignee: Stanadyne Automotive Corp., Windsor, Conn.

[ * ] Notice: The term of this patent shall not extend beyond the expiration date of Pat. No. 5,688,110.

[21] Appl. No.: 883,448

[22] Filed: Jun. 26, 1997

Related U.S. Application Data

[63] Continuation of Ser. No. 459,032, Jun. 2, 1995, Pat. No. 5,688,110.

[51] Int. Cl.[6] ..... F02M 41/10

[52] U.S. Cl. ..... 417/254; 417/265; 417/266

[58] Field of Search ..... 417/254, 265, 417/266, 273

[56] References Cited

U.S. PATENT DOCUMENTS

| | | | |
|---|---|---|---|
| 2,064,750 | 12/1936 | Hurst | 417/214 |
| 3,071,074 | 1/1963 | Bessiere | 417/542 |
| 4,173,959 | 11/1979 | Sosnowski et al. | 417/254 |
| 4,652,220 | 3/1987 | Mowbray | 417/265 |
| 4,889,096 | 12/1989 | Brunel | 417/254 |
| 5,228,844 | 7/1993 | Klopfer et al. | 417/440 |
| 5,318,001 | 6/1994 | Djordjevic | 123/450 |
| 5,688,110 | 11/1997 | Djordjevic | 417/254 |

FOREIGN PATENT DOCUMENTS

| | | |
|---|---|---|
| 1921291-A | 7/1993 | Germany . |
| 544083 | 6/1956 | Italy . |

OTHER PUBLICATIONS

Diesel Fuel Injection, published by Robert Bosch GmbH, 1 Jun. 1994, pp. 69–72.

International Search Report for International Application No. PCT/US96/08132.

*Primary Examiner*—Timothy S. Thorpe
*Assistant Examiner*—Ted Kim
*Attorney, Agent, or Firm*—Alix, Yale & Ristas, LLP

[57] ABSTRACT

A novel fuel pump arrangement comprises cam driven low and high pressure reciprocating plunger pump units. The fuel pump has rotary drive means, a high pressure pump with a pump body which defines a pumping chamber with an annular arrangement of a plurality of pairs of bores extending radially outwardly from a cam axis. A pumping plunger is mounted in each pumping plunger bore for reciprocation. The fuel pump also comprises a single transfer pump for transferring fuel under pressure to the pumping chamber. This transfer pump includes a single transfer plunger mounted within a transfer plunger bore for reciprocation to provide alternating intake and transfer phases of operation of the transfer pump. The fuel pump further includes an annular cam ring surrounding the high pressure pump body such that the cam ring is rotatable about the cam axis by the rotary drive to thereby cause reciprocation of the transfer plunger in predetermined synchronization with the high pressure pump whereby fuel is intermittently delivered for transfer to the high pressure pump.

19 Claims, 6 Drawing Sheets

FUEL PUMP HAVING DUAL PROFILE CAM RING FOR DRIVING LOW AND HIGH PRESSURE RECIPROCATING PLUNGERS

This is a continuation of U.S. application Ser. No. 08/459,032, filed in the United States on Jun 2, 1995, now U.S. Pat. No. 5,688,110.

BACKGROUND AND SUMMARY OF INVENTION

The present invention relates generally to fuel pumps of the type having a high pressure pump with one or more reciprocating pumping plungers for periodically delivering fuel at high pressure for fuel injection. Such a pump is referred to herein as a "Reciprocating Fuel Pump". The present invention relates more particularly to a Reciprocating Fuel Pump having a new and improved fuel transfer pump for transferring fuel intermittently to the high pressure pump.

The present invention has notable utility in a Reciprocating Fuel Pump of the type having a rotatable cam for reciprocating the pumping plungers (normally in synchronism with an associated internal combustion engine). Such a pump is referred to herein as a "Rotatable Cam Type Fuel Pump". For example, the present invention has notable utility in a Rotatable Cam Type Fuel Pump of the kind having a pump body with a plurality of radial pumping plungers and a cam ring surrounding the pump body and rotatable for reciprocating the pumping plungers. Such a pump is referred to herein as a "Rotatable Cam Ring Type Fuel Pump". U.S. Pat. No. 5,318,001, dated Jun. 7, 1994 and entitled "Distributor Type Fuel Injection Pump" discloses an example of a Rotatable Cam Ring Type Fuel Pump.

The present invention has utility in Reciprocating Fuel Pumps of both the distributor type (i.e., which deliver high pressure charges of fuel directly and sequentially to the fuel injectors of an associated engine) and non-distributor type (e.g., which deliver fuel at high pressure to a common rail fuel injection system). The present invention also has utility in Reciprocating Fuel Pumps other than Rotatable Cam Type Fuel Pumps and which for example have a fixed cam and rotatable pump body instead of a rotatable cam and fixed pump body.

In accordance with a principal aim of the present invention, a Reciprocating Fuel Pump is provided with a transfer pump for transferring fuel intermittently to the high pressure pump in timed relationship with the reciprocating pumping plungers. The transfer pump is operated at the same frequency as the high pressure pump and in synchronization with the high pressure pump so that the intermittent transfer phase of operation of the transfer pump occurs during the intermittent intake phase of operation of the high pressure pump. Optimum synchronization of the transfer pump and high pressure pump is established so that the transfer pump meets the fuel demand of the high pressure pump throughout the full range of speed and delivered fuel volume of the high pressure pump.

Another aim of the present invention is to provide in a Rotatable Cam Ring Type Fuel Pump, a new and improved transfer pump synchronized with the high pressure pump to transfer fuel intermittently to the high pressure pump uniformly and without cavitation.

Another aim of the present invention is to provide in a Reciprocating Fuel Pump, a new and improved transfer pump synchronized with the high pressure pump to transfer fuel intermittently to the high pressure pump with increased efficiency and lower drive torque.

Another aim of the present invention is to provide in a Rotatable Cam Ring Type Fuel Pump, a new and improved cam operated transfer pump integrated into the fuel pump with significantly less mechanical and hydraulic complexity than vane type transfer pumps conventionally employed in such fuel pumps.

Another aim of the present invention is to provide in a Rotatable Cam Ring Type Fuel Pump, a new and improved cam operated transfer pump and a new and improved oil system for lubricating the cam and cam follower mechanisms of the transfer pump and high pressure pump. In accordance with this aim, the fuel pump has an internal oil system connected to receive oil from and return oil to the associated engine without fuel contamination of the oil.

Another aim of the present invention is to provide in a Rotatable Cam Ring Type Fuel Pump, a new and improved cam operated transfer pump for transferring fuel intermittently to the high pressure pump and a new and improved cam operated supply pump integrated with the transfer pump for supplying fuel intermittently to the transfer pump.

A further aim of the present invention is to provide in a Reciprocating Fuel Pump, a new and improved transfer pump synchronized with the high pressure pump to transfer fuel intermittently to the high pressure pump in optimum synchronism with the intermittent fuel demand of the high pressure pump throughout the full range of speed and delivered fuel volume of the high pressure pump.

Another aim of the present invention is to provide a new and improved Rotatable Cam Ring Type Fuel Pump which can be more economically manufactured; which provides oil lubrication of the rotatable cam and cam follower mechanisms of the pump to permit the delivery of fuel from the high pressure pump at 16,000 psi and higher; which can be used with internal combustion engines having two to eight cylinders or more; and which is electrically controlled to precisely regulate the volume and/or timing of the high pressure delivery of fuel by the pump.

Other objects will be in part obvious and in part pointed out more in detail hereinafter.

A better understanding of the invention will be obtained from the following detailed description and the accompanying drawings of illustrative embodiments of the invention.

DESCRIPTION OF PREFERRED EMBODIMENTS

Figure 1:
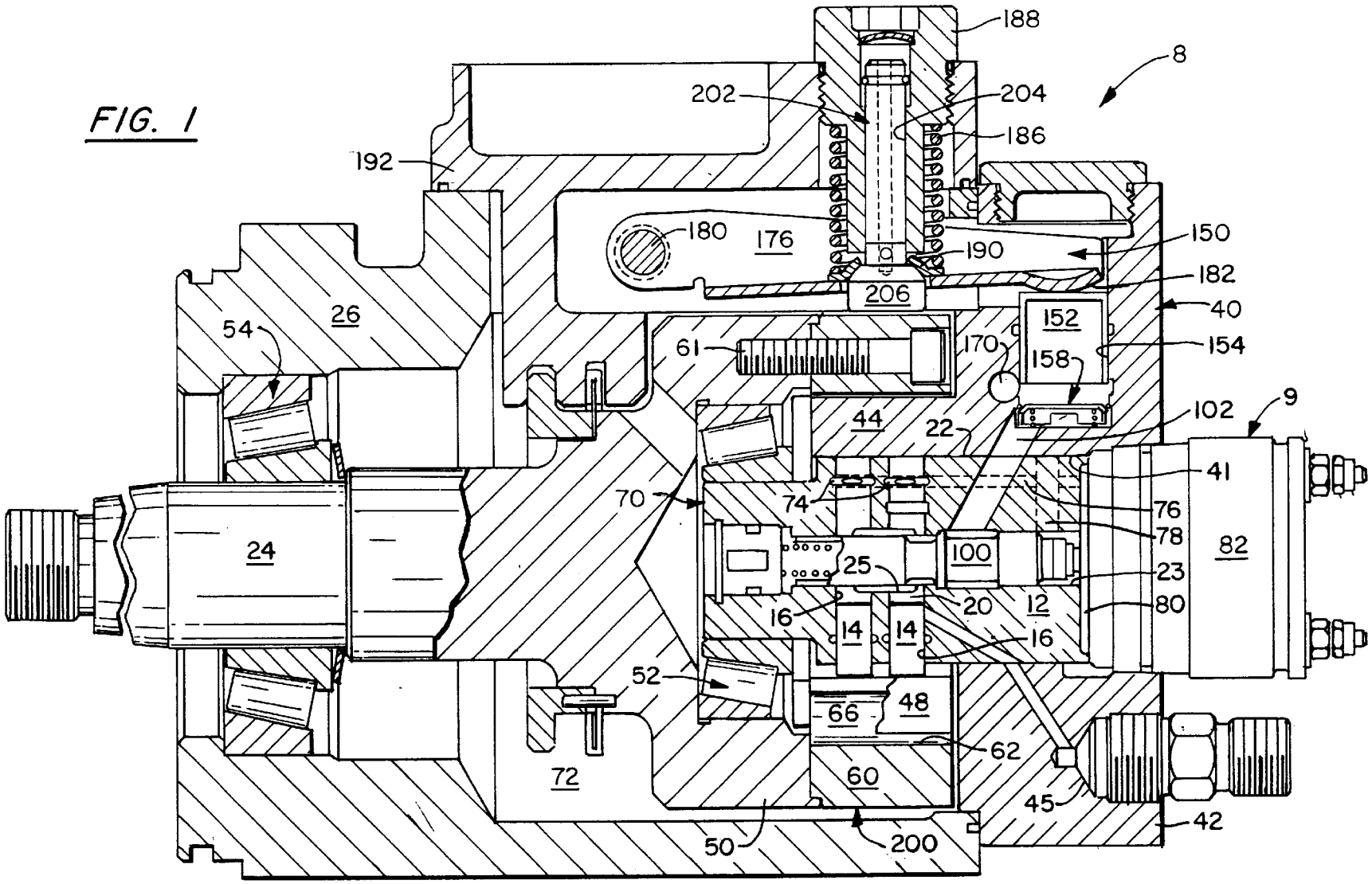
FIG. 1 is a longitudinal section view, partly broken away and partly in section, of a Rotary Cam Ring Type Fuel Pump incorporating an embodiment of the present invention.

In the drawings, the same numerals are used to identify the same or like functioning parts or components. FIG. 1 shows a Rotary Cam Ring Type Fuel Pump 8 incorporating an embodiment of the present invention. The pump 8 is a distributor pump having a distributor system of the type described in U.S. Pat. No. 5,318,001, dated Jun. 7, 1994, and entitled "Distributor Type Fuel Injection Pump". The disclosed pump 8 is designed to deliver high pressure charges of fuel directly and sequentially to the fuel injectors (not shown) of an associated internal combustion engine (not shown) for fuel injection.

An electrical control valve 9 is provided for regulating the volume and timing of each fuel charge delivered by the pump 8. The control valve 9 may be designed and operated to provide a spill-pump-spill mode of operation or a fill-spill mode of operation of the type described in U.S. Pat. No. 4,757,795, dated Jul. 19, 1988, and entitled "Method And Apparatus For Regulating Fuel Injection Timing And Quantity". The disclosed pump 8 is designed and operated to provide such a fill-spill mode of operation.

U.S. Pat. Nos. 5,318,001 and 4,757,795, which are incorporated herein by reference, provide a detailed explanation of the distributor system and fill-spill mode of operation.

The disclosed pump 8 is designed for use with a six-cylinder engine. The pump 8 has a fixed pump body 12 with twelve radial bores 16. The twelve bores 16 are arranged in two axially spaced banks, each having six equiangularly spaced, radial bores 16. The six radial bores 16 in each bank are angularly aligned with the six radial bores 16 in the other bank. A pumping plunger 14 is mounted in each bore 16 to provide six pairs of aligned plungers 14, a pair of plungers 14 for each engine injector.

The plunger bores 16 extend inwardly from an outer cylindrical surface 22 of the pump body 12 to a central coaxial throughbore 23 in the pump body 12. An internal coaxial annulus 25 connects the inner ends of the radial bores 16 to form a single high pressure pumping chamber 20. The pump body 12 and plungers 14 are made of a wear-resistant steel alloy and have a very precise fit.

A fixed outer head 40, which forms part of a pump housing 26, has a cylindrical bore 41 receiving and supporting the pump body 12. The head 40 is made of steel whereas the rest of the multipart housing 26 is preferably made of aluminum. The pump body 12 has a press fit within the head 40 to seal their cylindrical interface against fuel leakage. The head 40 provides an outer distributor head 42 and an inner roller shoe support hub 44. The distributor head 42 has six equiangularly spaced distributor outlets 45, one for each fuel injector. The hub 44 has six equiangularly spaced radial slots 46, each supporting a roller shoe 48 for a pair of aligned plungers 14.

A pump drive shaft 24 has an enlarged integral flange 50 at its inner end. A tapered roller bearing 52 is mounted between the inner end flange 50 and the pump body 12. A second tapered roller bearing 54 is provided between the drive shaft 24 and pump housing 26. The drive shaft 24 is thereby rotatably mounted coaxial with the fixed pump body 12. The pump 8 is adapted to be mounted on an associated engine so that the pump drive shaft 24 is rotated by the engine, normally at one-half engine speed.

An annular cam ring 60 is secured to the inner end flange 50 of the drive shaft 24 by six angularly spaced machine screws 61. The cam ring 60 surrounds the pump body 12 and hub 44. The cam ring 60 provides an inner annular cam 62 with an internal cam surface with five full cam lobes 64 (i.e., one less than the number of plunger pairs) and one distributor ramp 65. The six cam segments 64, 65 have the same angular pitch as the six pairs of plungers 14 and respective plunger actuating rollers 66. The cam lobes 64 periodically actuate the rollers 66, roller shoes 48 and plungers 14 inwardly during rotation of the shaft 24.

A high pressure reciprocating pump 70 is formed by the fixed pump body 12, rotatable cam 62, plungers 14, roller shoes 48 and rollers 66. During each cycle of operation of the high pressure pump 70, one plunger 14 is employed as a distributor valve connecting the pumping chamber 20 to a respective distributor outlet 45. During each revolution of the cam 62, the six pairs of plungers 14 are positioned and actuated by the internal cam 62 to deliver high pressure charges of fuel to the six distributor outlets 45 in sequence. The rollers 66, roller shoes 48 and internal cam 62 have an axial width greater than the total axial width of the two banks of plungers 14. The plunger diameter and stroke are established to optimize the plunger stroke for the largest volume of fuel to be delivered by the high pressure pump 70.

Engine oil is supplied under pressure from the engine oil system to the pump to maintain the housing cavity 72 partly filled with oil. Excess oil is returned to the engine oil sump through the outer shaft bearing 54. Oil is thereby circulated through the housing cavity to provide splash lubrication of the cam 62, rollers 66 and roller shoes 48 (and splash lubrication of the moving parts of a transfer pump 150, hereafter described). The internal oil system is maintained completely separate from the internal fuel system without requiring special seals to prevent fuel contamination of the oil. Fuel leakage between the pumping plungers 14 and bores 16 is returned to the fuel tank via low pressure annuli 74 surrounding the bores 16 and via drilled passages 76, 78 in the pump body 12 connecting the annuli 74 to a low pressure end chamber 80 at the outer end of the pump body 12. A drilled passage (not shown) is provided in the distributor head 42 for returning fuel from the end chamber 80 to the fuel tank.

The control valve 9 has a valve operating solenoid 82 and an elongated valve member 100 mounted in the throughbore 23. Fuel is transferred to the pumping chamber 20 via a radially extending fuel inlet passage 102 in the distributor head 42 and pump body 12 and via the valve member 100 to force the plunger mechanisms (comprising the plungers 14, roller shoes 48 and rollers 66) outwardly against the cam 62. The control valve 9 is timely closed, normally before the end of the intake phase of the cam 62, by energizing the valve solenoid 82. The volume of fuel delivered to the pumping chamber 20 before the valve 9 is closed is determined by the profile of the cam 62.

The valve 9 remains closed until after the high pressure delivery of fuel during the following pumping phase of the cam 62. During the pumping phase, any play within the plunger mechanisms is eliminated first and then the pumping plungers 14 are actuated inwardly by the cam 62 to deliver a charge of fuel from the pumping chamber 20 at high pressure. The valve solenoid 82 is normally deenergized before the end of the pumping phase to open the control valve 9 and spill fuel from the pumping chamber 20 and thereby terminate the high pressure delivery of fuel. A drilled passage 106 in the distributor head 42 connects the fuel inlet passage 102 to a return line connector 110 for returning spilled fuel to the fuel tank (not shown). A pressure regulator or relief valve 112 in the connector 110 is opened to return spilled fuel to the fuel tank when the spill pressure reaches a predetermined optimum level (e.g., 500 psi) significantly higher than the maximum transfer or inlet pressure provided by the transfer pump 150.

The transfer pump ("TP") 150 is employed for transferring fuel intermittently to the pumping chamber 20 at the high frequency of the reciprocating pumping plungers 14 (e.g., at a maximum frequency of 175 CPS for a four cycle, six cylinder engine having a maximum speed of 3,500 RPM). The transfer pump 150 has a light, hollow TP plunger 152 mounted in a radial TP bore 154 in the distributor head 42 (between a pair of distributor outlets 45). The inner end of the TP bore 154 is connected directly to the fuel inlet passage 102 close to the valve member 100 to reduce the length and inertia of the fuel column between the TP bore 154 and high pressure chamber 20 and thereby to reduce the reaction time for delivering fuel to the pumping chamber 20 at the beginning of the intake phase of the cam 62. Also, the diameter of the TP plunger 152 and diameter of the fuel inlet passage 102 are made relatively large to reduce the reaction time.

Figure 5:
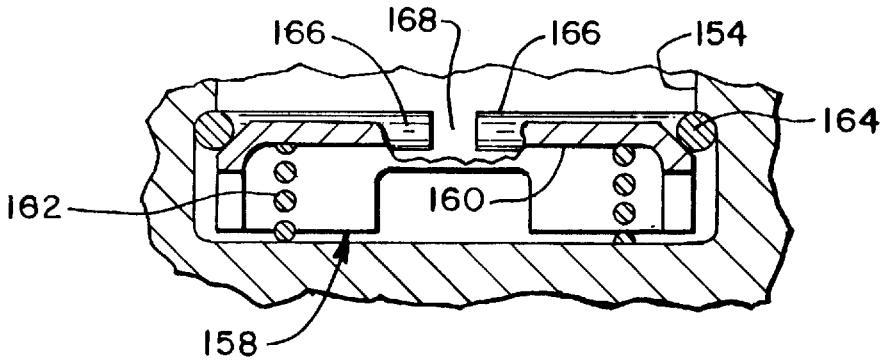
FIG. 5 is an enlarged, partial, transverse section view, partly broken away and partly in section, of the fuel pump of FIG. 1, showing an outlet check valve of a transfer pump of the fuel pump.
Figure 6:
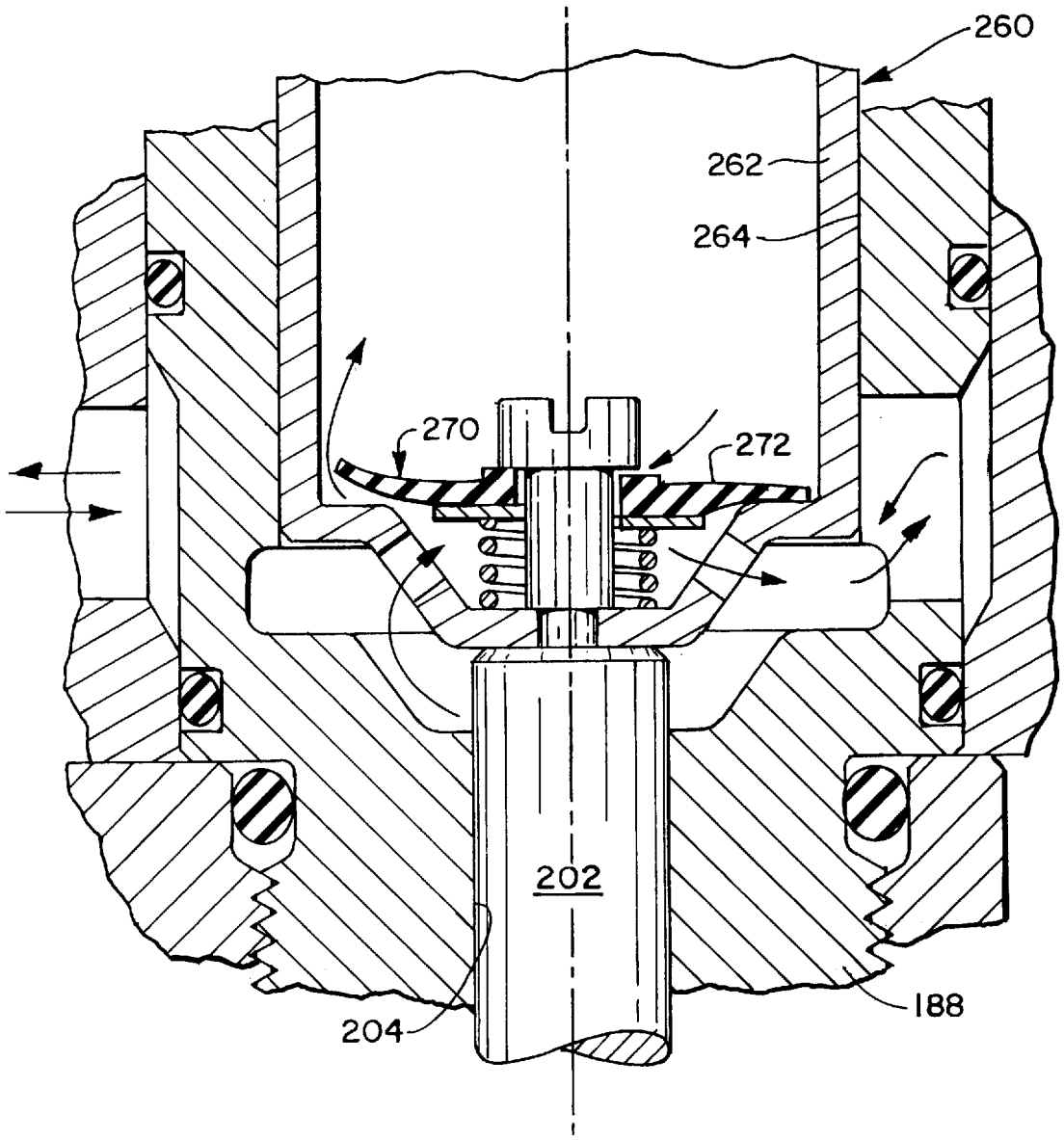
FIG. 6 is an enlarged, partial, longitudinal section view, partly broken away and partly in section, of the modified fuel pump of FIG. 2, showing a combination inlet valve and pressure relief valve of the fuel supply pump.

A one-way, inlet check valve 156 is provided in the inlet line 170 to the TP bore 154. Accordingly, the TP plunger 152 provides a one-way, positive displacement transfer plunger for transferring fuel under pressure to the high pressure chamber 20. A one-way, outlet check valve 158 is provided at the inner end of the TP bore 154 to limit the reverse flow of fuel to the TP bore 154 from the high pressure chamber 20. The outlet check valve 158 comprises a circular valve member 160 and a compression spring 162 biasing the valve member 160 outwardly into engagement with a valve seat provided by a split retaining ring 164. The ends 166 of the split ring 164 are spaced apart as shown in FIG. 5 to provide a bypass opening 168 when the valve member 160 is seated against the ring 164. A bypass opening may be provided in the valve member 160 instead. The bypass opening 168 serves to dampen the high pressure spikes transmitted from the high pressure chamber 20 when the control valve 9 is initially opened. The bypass opening 168 also serves to return part of the spilled fuel from the high pressure chamber 20 to the TP bore 154. By returning spilled fuel to the TP bore 154, the volume of fresh fuel required to be supplied to the TP bore 154 via the TP inlet line 170 is reduced and the life of the inlet fuel filter 172 is thereby extended. The volume of spilled fuel returned to the TP bore 154 during each pumping cycle varies with engine speed (e.g., varies from 40% of the spilled volume at engine idle to 10% at maximum speed). The spilled volume returned to the TP bore 154 per minute remains generally constant throughout the full speed range of the engine and is established so that the hot returned fuel does not cause any overheating.

The TP plunger 152 is actuated inwardly by a light TP lever 176 having one end pivotally mounted on the pump housing 26 by a pivot pin 180. The TP lever 176 has a bottom 177 and a pair of opposed, upright sides 178 providing a rigid U-shape. A convex, cylindrical bearing surface 182 is provided on the outer free end of the TP lever 176 for engagement with the outer flat end face of the TP plunger 152 to accommodate the relative movement of the TP lever 176 and TP plunger 152. In the disclosed embodiment, the pivotal axis of the TP lever 176 is perpendicular to and radially offset from the axis of the shaft 24. If desired, the transfer pump 150 may be located and configured so that the axis of the TP lever is parallel to the shaft axis.

The TP lever 176 is biased inwardly by a TP compression spring 186 seated between a fixed spring support hub 188 and a thrust washer 190 engaging the TP lever 176. The spring support hub 188 is mounted within a threaded radial bore in a removable cover 192 forming part of the multipart housing 26. The TP spring 186 serves to actuate the TP lever 176 and TP plunger 152 inwardly to transfer fuel to the pumping chamber 20. The spring force and spring rate of the TP spring 186 are established to reflect the lever amplified stroke of the TP plunger 152.

The cam ring 60 provides an outer annular cam 200 with an outer cam surface for operating the transfer pump 150. The TP spring 186 is periodically compressed by the TP cam 200 via a tappet or actuator pin 202. The tappet 202 extends through the TP lever 176, thrust washer 190 and TP spring 186 and is reciprocally mounted within a coaxial bore 204 in the spring support hub 188. An enlarged head 206 on the inner end of the tappet 202 serves as a tappet head or follower engageable by the TP cam 200. The tappet head 206 has an upper partly spherical surface engaging a conforming inner annular surface on the thrust washer 190. The TP cam 200 has six equiangularly spaced cam lobes 210 which periodically actuate the tappet 202 outwardly against the bias of the TP spring 186. The tappet 202 is thereby actuated outwardly six times during each revolution of the drive shaft 24, once for each pumping cycle of the high pressure pump 70. Each cam lobe 210 provides a maximum tappet lift of for example 0.125 inch and a corresponding TP plunger stroke of 0.220 inch. During each outward actuation of the tappet 202 by the TP cam 200, the TP plunger 152 and TP lever 176 are actuated upwardly (retracted) by the fuel supplied to the TP bore 154 from the TP inlet line 170 and the pumping chamber 20. After each such retraction of the TP lever 176 and TP plunger 152, the transfer pump 150 is loaded to transfer fuel to the high pressure chamber 20 on demand during the following intake phase of operation of the high pressure pump 70.

As indicated, the internal oil system provides for splash lubrication of the moving parts of the transfer pump 150, including the TP cam 200, tappet 202, thrust washer 190, TP lever 176 and TP plunger 152.

Figure 8:
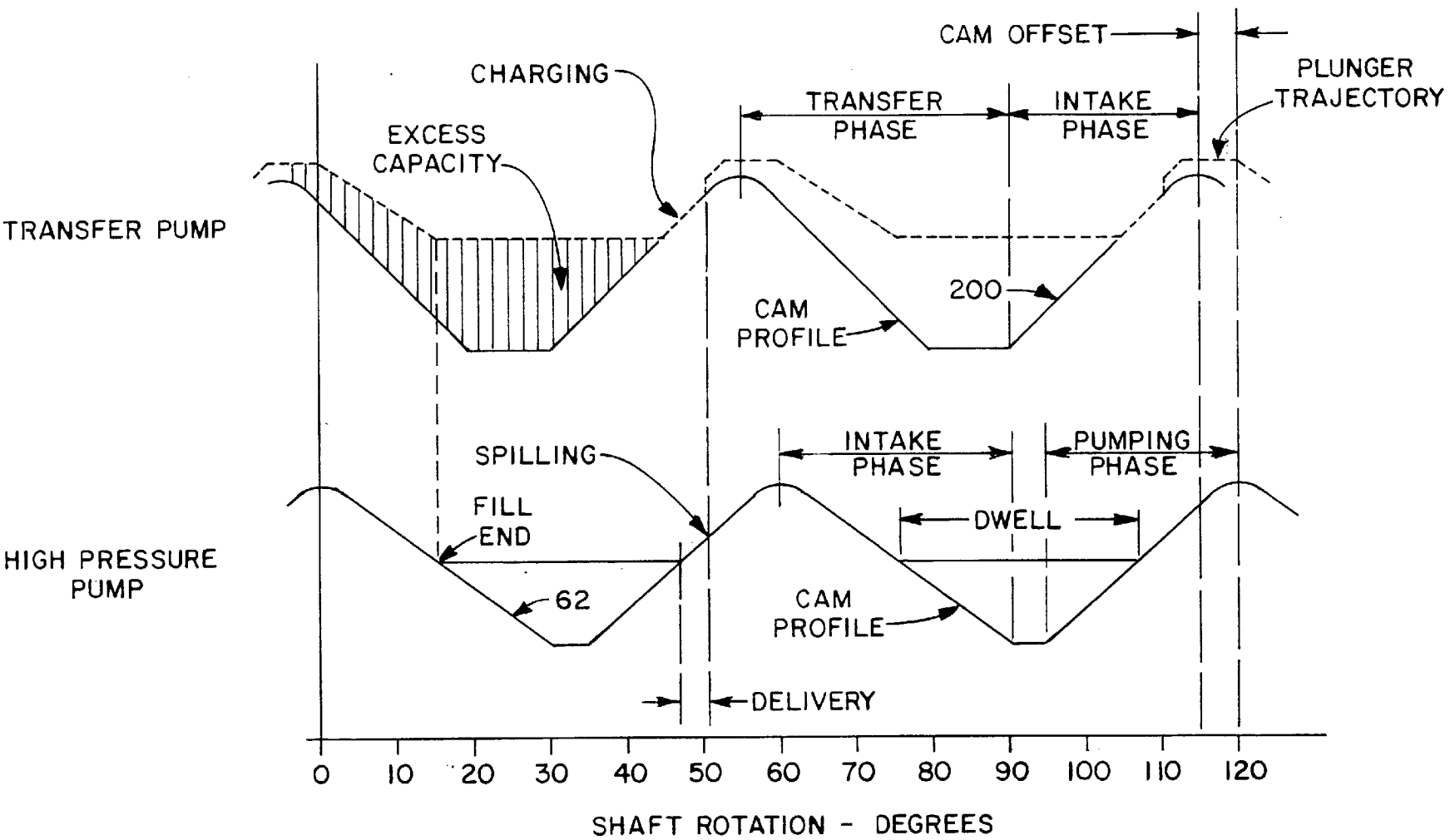
FIG. 8 is a timing diagram showing the operating cycles of the transfer pump and a high pressure pump of the fuel pump of FIG. 1.

A timing diagram showing the operating cycles of the transfer pump 150 and high pressure pump 70 is shown in FIG. 8. The two operating cycles have the same frequency and duration of 60° of drive shaft rotation. The transfer pump 150 is synchronized with the high pressure pump 70 in out-of-phase relationship with the high pressure pump (i.e., with a phase separation of approximately one-half cycle or 30° of drive shaft rotation). The intake phase of operation of the transfer pump 150 (provided by the cam 200) occurs primarily during the pumping phase of operation of the high pressure pump 70 (provided by the cam 62) and the transfer phase of operation of the transfer pump 150 occurs during the intake phase of operation of the high pressure pump 70. The cam 200 is angularly offset slightly so that the intake phase of the cam 200 ends a few degrees (e.g., 5° of drive shaft rotation) before the beginning of the intake phase of the cam 62 and so that the TP plunger 152 is conditioned for transferring fuel to the pumping chamber 20 a few degrees before the beginning of the intake phase of operation of the high pressure pump 70.

The capacity of the transfer pump 150 is greater than (preferably no more than approximately 10% greater than) the capacity of the high pressure pump 70 so that the transfer pump 150 can fully meet the intermittent and variable fuel demand of the high pressure pump 70 throughout the full range of speed and delivered fuel volume of the high pressure pump 70. The diameter and stroke of the TP plunger 152 are established to provide the desired transfer pump capacity. In the disclosed pump 8, the transverse area of the TP plunger 152 is preferably approximately equal to ten times the transverse area of a single pumping plunger 14 (i.e., approximately equal to the total transverse area of the ten active pumping plungers 14). Also, the maximum stroke of the TP plunger 152 provided by the TP cam 200 is preferably approximately equal to but slightly greater than the maximum stroke of the TP plungers 14.

As indicated, the transfer plunger 152 is fully loaded at the beginning of the intake phase of operation of the high pressure pump 70 to transfer fuel to the high pressure pump 70 on demand. At that point, the TP spring 186 is fully compressed and the highest transfer pressure (e.g., 200 psi) is generated to overcome the initial inertia of the system. The inward displacement of the transfer plunger 152 is directly related to the volume of fuel transferred to the high pressure chamber 20. Thus, the following compression of the TP spring 186 is also directly related to that fuel volume. Accordingly, the energy required to compress the TP spring 186 is held to a minimum and is significantly less at engine idle than at maximum engine load. A relatively low average drive torque is therefore required to operate the transfer pump 150. Also, the average drive torque is reduced by the volume of spilled fuel returned to the TP bore 154 from the high pressure chamber 20. As shown in FIG. 8, the fuel returned to the TP bore 154 at the end of the delivery phase of the high pressure pump 70 can lift the tappet 202 off the TP cam 200 and compress the TP spring 186 beyond that provided by the TP cam 200.

A suitable fuel supply pump is provided for supplying fuel to the transfer pump 150 at the desired inlet pressure (e.g., between 40 psi and 80 psi). A conventional reciprocating supply pump (not shown) mounted on and driven by the associated engine may be employed for that purpose. If not mounted on the engine, the supply pump is preferably integrated into the fuel pump 8.

Figure 2:
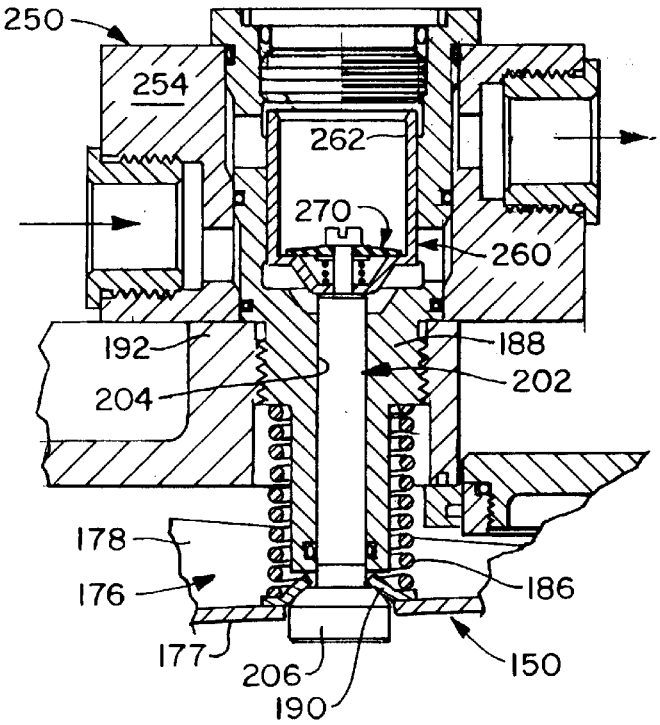
FIG. 2 is a partial, longitudinal section view, partly broken away and partly in section, of the fuel pump of FIG. 1 as modified to incorporate an integrated fuel supply pump.
Figure 3:
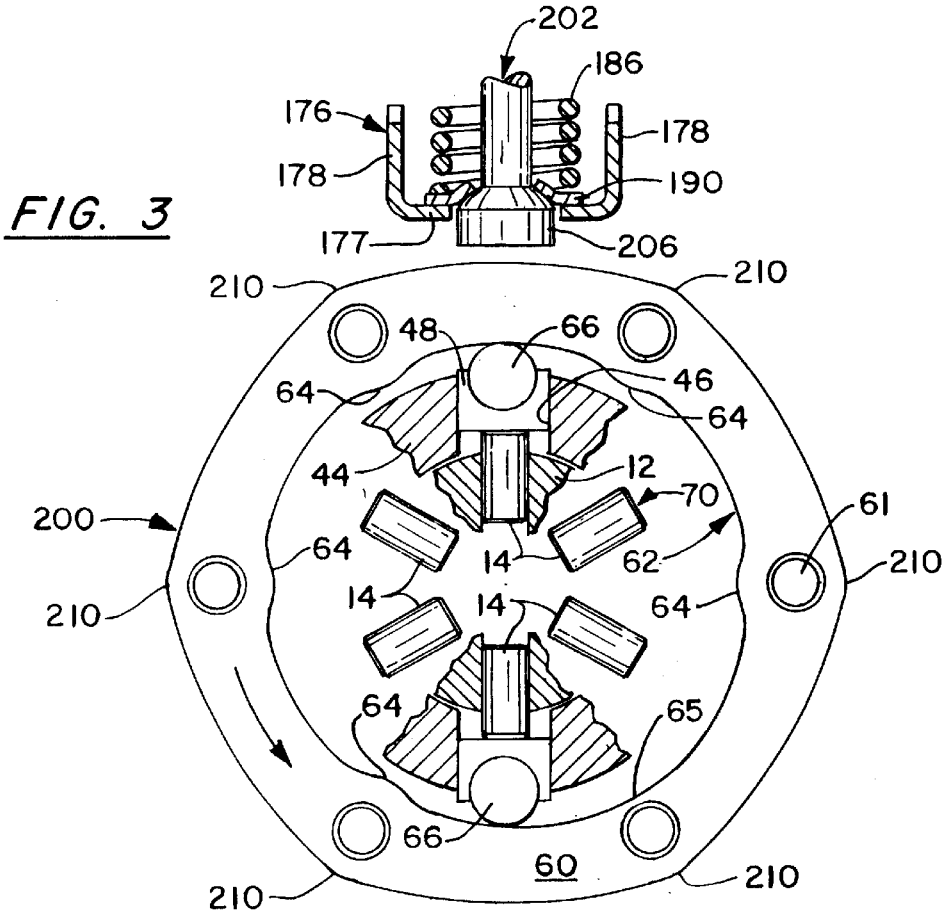
FIG. 3 is a partial, transverse section view, partly broken away and partly in section, of the fuel pump of FIG. 1, showing cam and cam follower mechanisms of the fuel pump.
Figure 4:
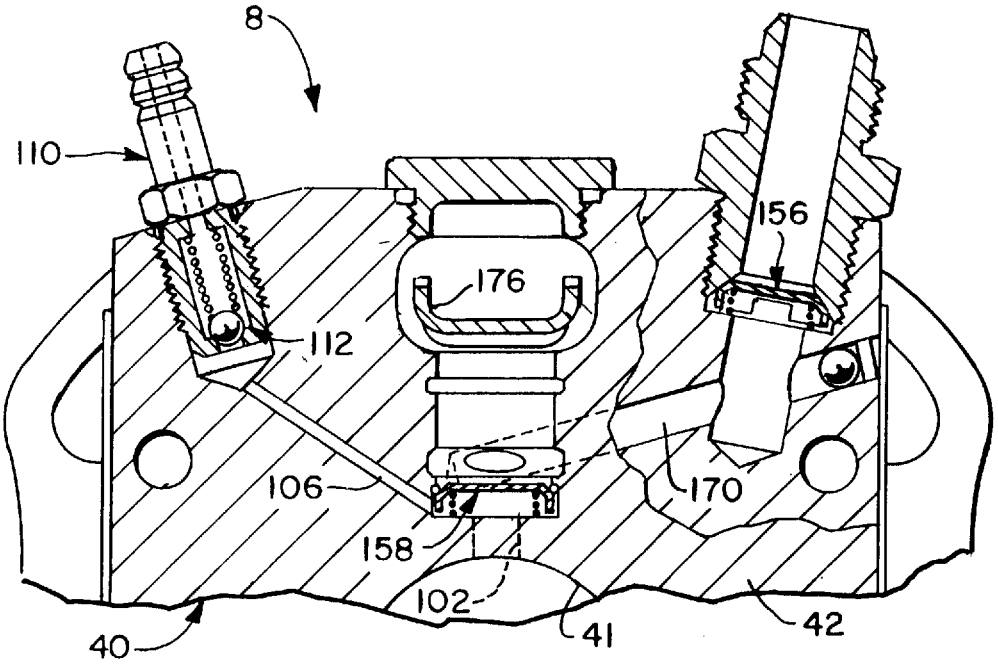
FIG. 4 is a partial, transverse section view, partly broken away and partly in section, of the fuel pump of FIG. 1, showing certain valves and fuel passages of the fuel pump.
Figure 7:
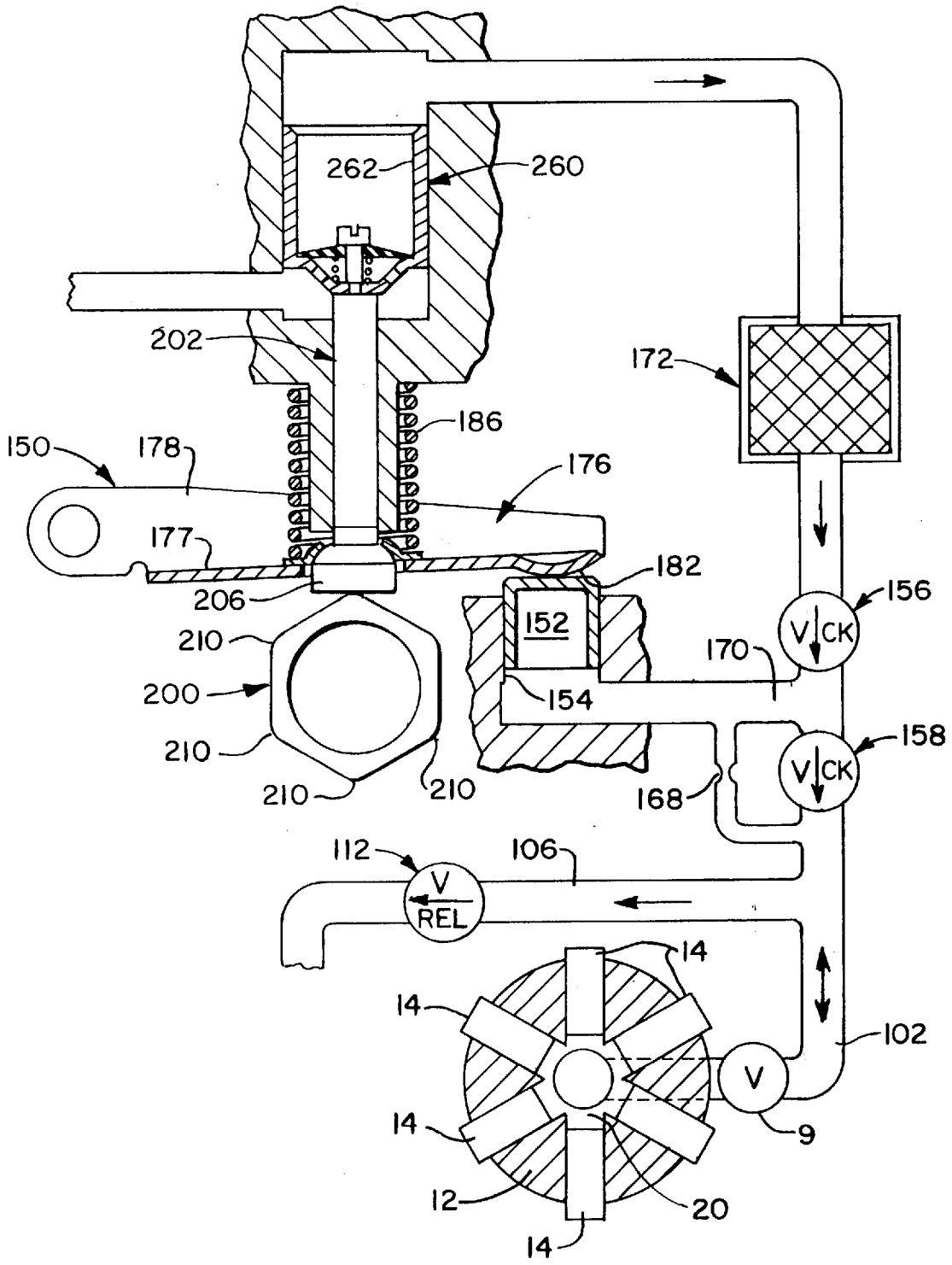
FIG. 7 is a partial schematic of a fuel pump installation employing the modified fuel pump of FIG. 2.

Referring to FIGS. 2 and 7, a supply pump module 250 is installed on the housing 26 in place of the tappet subassembly comprising the tappet 202, TP spring 186, TP spring support hub 188 and thrust washer 190. The module 250 includes a similar tappet subassembly mounted within a radial bore in a separate module housing 254. An integrated supply pump ("SP") 260 is provided at the outer end of the tappet 202. The supply pump 260 receives fuel from the fuel tank and supplies fuel to the TP bore 154 via the inlet fuel filter 172 and inlet check valve 156. The supply pump 260 has a light, hollow SP plunger 262 mounted in an outer coaxial bore 264 in an elongated spring support hub 188. The SP plunger 262 is fixed to the outer end of the tappet 202 and is actuated outwardly by the tappet 202 to supply fuel to the TP plunger bore 154. The SP plunger 262 is retracted inwardly by the tappet 202 to refill the SP bore 264 during the transfer of fuel from the transfer pump 150 to the high pressure pump 70. The capacity of the supply pump 260 is preferably approximately equal to but slightly greater than the capacity of the transfer pump 150. Accordingly, the transverse area of the SP plunger 262 is sufficiently greater than that of the TP plunger 152 to offset the greater stroke of the TP plunger 152.

A combination valve 270 providing an inlet check valve and pressure relief valve is mounted within the hollow SP plunger 262. The inlet check valve is provided by a circular valve member 272 adapted to flex outwardly to fill the SP bore 264 when the SP plunger 262 is retracted inwardly. The circular valve member 272 is adapted to be actuated inwardly against a compression spring to provide a pressure relief valve for returning fuel to the supply pump inlet when the SP pressure exceeds a predetermined maximum pressure (e.g., 80 psi).

As will be apparent to persons skilled in the art, various modifications, adaptations and variations of the foregoing specific disclosure can be made without departing from the teachings of the present invention.

What is claimed is:

1. In a fuel pump having rotary drive means; a high pressure pump with a pump body with a pumping chamber with an annular arrangement of a plurality of pumping plunger bores extending radially outwardly from a cam axis, a pumping plunger mounted in each pumping plunger bore for reciprocation and first cam means surrounding the pump body and rotatable about said cam axis by the rotary drive means for reciprocating each pumping plunger to provide alternating intake and pumping phases of operation of the high pressure pump, at a frequency determined by the speed of the rotary drive means, for respectively receiving an intake charge of fuel and delivering fuel from the pumping chamber at high pressure; and a transfer pump for transferring fuel under pressure to the pumping chamber; the improvement wherein the transfer pump comprises a transfer plunger bore, a transfer plunger mounted in the transfer plunger bore for reciprocation to provide alternating intake and transfer phases of operation of the transfer pump, and second cam means rotatable by the rotary drive means for reciprocating the transfer plunger in predetermined synchronism with the high pressure pump to transfer fuel intermittently to the high pressure pump, and wherein the first cam means and the second cam means are provided by an annular cam ring surrounding the high pressure pump body.

2. A fuel pump according to claim 1, wherein the maximum displacement of said reciprocating transfer plunger is greater than the maximum displacement of the high pressure pump.

3. A fuel pump according to claim 1, wherein the maximum displacement of said transfer plunger is no more than approximately 10% greater than the maximum displacement of the high pressure pump.

4. A fuel pump according to claim 1, further comprising selectively operable valve means for transferring fuel from the transfer pump to the high pressure pump at the same frequency as the high pressure pump during the intake phase of the high pressure pump and for spilling fuel from the high pressure pump during the pumping phase of the high pressure pump, and wherein the transfer pump further comprises reverse flow control means for providing limited reverse flow of spilled fuel from the high pressure pump to said transfer plunger bore.

5. A fuel pump according to claim 1, further comprising a fuel passage connecting the transfer pump and the high pressure pump for transferring fuel from the transfer pump to the high pressure pump, valve means selectively operable for spilling fuel from the high pressure pump into said fuel passage during the pumping phase of operation of the high pressure pump, and reverse flow control means providing limited reverse flow of spilled fuel from said fuel passage to said transfer plunger bore.

6. A fuel pump according to claim 1, further comprising a distributor head surrounding the pump body and having a plurality of distributor outlets spaced around the pump body and connected in sequence for receiving high pressure fuel from the pumping chamber, and wherein said transfer plunger bore is provided in the distributor head.

7. The fuel pump according to claim 1, wherein said transfer plunger bore is the only plunger bore within the transfer pump.

8. The fuel pump according to claim 1, wherein the pumping plunger bores are arranged in pairs extending radially outwardly from the cam axis.

9. In a fuel pump connected to a fuel supply and having rotary drive means; a high pressure pump with a pump body with a pumping chamber with an annular arrangement of a plurality of pairs of pumping plunger bores extending radially outwardly from a cam axis, a pumping plunger mounted in each pumping plunger bore for reciprocation and first cam means surrounding the pump body and rotatable about said cam axis by the rotary drive means for reciprocating each pumping plunger to provide alternating intake and pumping phases of operation of the high pressure pump at a frequency determined by the speed of the rotary drive means, for respectively receiving an intake charge of fuel and delivering fuel from the pumping chamber at high pressure; and a transfer pump for raising the pressure of fuel from the fuel supply for transfer to the pumping chamber; wherein the improvement comprises:

the transfer pump includes means defining a transfer plunger bore, and a transfer plunger mounted in said transfer plunger bore for reciprocation therein to provide alternating intake and transfer phases of operation of the transfer pump; and second cam means, the first cam means and the second cam means being provided by respective inner and outer profiles on an annular cam ring surrounding the pump body such that the second cam means is rotatable by the rotary drive means for reciprocating the transfer plunger in predetermined synchronism with the high pressure pump to raise the pressure of fuel from the fuel supply for transfer to the high pressure pump.

10. A fuel pump according to claim 9, wherein the maximum displacement of said reciprocating transfer plunger is greater than the maximum displacement of the high pressure pump.

11. A fuel pump according to claim 9, wherein the maximum displacement of said transfer plunger is no more than approximately 10% greater than the maximum displacement of the high pressure pump.

12. A fuel pump according to claim 9, further comprising selectively operable valve means for transferring fuel from the transfer pump to the high pressure pump during the intake phase of the high pressure pump and for spilling fuel from the high pressure pump during the pumping phase of the high pressure pump, and wherein the transfer pump further comprises reverse flow control means providing limited reverse flow of spilled fuel from the high pressure pump to said transfer plunger bore.

13. A fuel pump according to claim 9, further comprising a fuel passage connecting the transfer pump and the high pressure pump for transferring fuel from the transfer pump to the high pressure pump, valve means selectively operable for spilling fuel from the high pressure pump into said fuel passage during the pumping phase of the high pressure pump, and reverse flow control means providing limited reverse flow of spilled fuel from said fuel passage to said transfer plunger bore.

14. A fuel pump according to claim 9, further comprising a distributor head surrounding the pump body and having a plurality of distributor outlets spaced around the pump body and connected in sequence for receiving high pressure fuel from the pumping chamber, and wherein said transfer plunger bore is provided in the distributor head.

15. A fuel pump according to claim 9, wherein said transfer plunger bore is the only plunger bore within the transfer pump.

16. In a fuel pump of the type having a rotary drive means, a high pressure pump with a pump body which defines a pumping chamber comprising an annular arrangement of a plurality of pumping plunger bores extending radially outwardly from a cam axis, a pumping plunger mounted in each pumping plunger bore for reciprocation, and a transfer pump for transferring fuel under pressure to the pumping chamber, wherein the improvement comprises:

means for defining a single transfer plunger bore within the transfer pump;

a transfer plunger reciprocally mounted in said transfer plunger bore to provide alternating intake and transfer phases of operation of the transfer pump; and an annular cam ring surrounding the pump body, said cam ring being rotatably mounted for rotation about the cam axis, being driven by the rotary drive means, and comprising first and second camming surfaces, said first camming surface cooperating with the pumping plungers to cause reciprocation thereof at a frequency determined by the speed of the rotary drive means whereby the high pressure pump receives and delivers fuel at high pressure during respective and alternating intake and pumping phases of operation, said second camming surface cooperating with said transfer plunger to cause reciprocation thereof in predetermined synchronism with the high pressure pump.

17. The fuel pump according to claim 16, wherein said transfer plunger bore is the only plunger bore within the transfer pump.

18. The fuel pump according to claim 17, wherein the pumping plunger bores are arranged in pairs extending radially outwardly from the cam axis.

19. A fuel pump according to claim 18, wherein the first camming surface is defined by a radially inner surface of the cam ring and the second camming surface is defined by a radially outer surface of the cam ring.

* * * * *